United States Patent [19]

Nessi

[11] 4,296,622

[45] Oct. 27, 1981

[54] DEVICE FOR INSERTING AND THRUSTING A BAR INTO A PRESS PIERCING MILL

[75] Inventor: Aurindo Nessi, Albate (Como), Italy

[73] Assignee: Innocenti Santeustacchio S.p.A., Brescia, Italy

[21] Appl. No.: 29,072

[22] Filed: Apr. 11, 1979

[30] Foreign Application Priority Data

Apr. 21, 1978 [IT] Italy ..... 22600 A/78

[51] Int. Cl.[3] ..... B21B 17/00; B21B 19/04

[52] U.S. Cl. ..... 72/208; 72/250; 72/97

[58] Field of Search ..... 72/209, 97, 252, 250, 72/208

[56] References Cited

U.S. PATENT DOCUMENTS 2,024,514 12/1935 Drescher ..... 72/97 X 2,958,244 11/1960 Rodder ..... 72/97

*Primary Examiner*—Milton S. Mehr

*Attorney, Agent, or Firm*—Birch, Stewart, Kolasch & Birch

[57] ABSTRACT

The present invention is directed to a device for inserting and thrusting a bar into a double rolling pressure piercing mill (PPM) machine comprises a drum-shaped bedplate coaxially keyed to a motor-driven shaft having its axis of rotation parallel to the PPM's rolling axis, a first and a second thrust means on the drum-shaped bedplate having acting lines (R $R_1$) parallel to the PPM's rolling axis and circumferentially spaced from each other by a predetermined center angle, a motor for angularly moving the drum-shaped bedplate from a position in which the line R coincides with the rolling axis to a second position in which the line $R_1$ coincides with said rolling axis and vice-versa.

6 Claims, 4 Drawing Figures

4
3
5
A
6
7
6a
10b
19
34
III
III
24
24
19
23
7
24
18
IV
IV
20
17
21
15
20
16
110b
14
10
17a
12
R
13
12

1
2
4
5
A
3
6
7
6a
10b
9
25
30
24
23
7
24
11
9
18
17
8
10
15
11
17a
16
14
9
13
R
11
12
9a

DEVICE FOR INSERTING AND THRUSTING A BAR INTO A PRESS PIERCING MILL

BACKGROUND OF THE INVENTION

The invention relates to a device for inserting and thrusting a square bar into a press piercing mill, the bar being disposed along the rolling and drilling axis of the mill. More specifically, the invention relates to a device for performing the following operations in a fixed sequence:

(a) Positioning a square bar along the rolling and piercing axis of a press piercing mill at its inlet side, (b) Inserting the bar through the inlet guide of the press piercing mill, and (c) Inserting and thrusting the bar between the rolls and against the drill bit of the mill.

A press-piercing mill is a machine capable of converting a hot square bar into a round, axially pierced blank. A machine of the aforementioned kind, which hereinafter will be denoted by the abbreviation PPM, substantially comprises a double rolling machine comprising rolls having round grooves, a mandrel bearing a bit and mounted along the rolling and piercing axis of the rolling machine on the outlet side thereof, a drill bit secured to the end of the mandrel facing the rolling machine, and a substantially tunnel inlet guide coaxial with the rolling and piercing axis, for guiding a square bar to the rolling machine.

In order to convert a square bar into a round, axially pierced blank in a PRM, the bar must be held exactly along the rolling axis of the machine and thrust between the grooves in rolls and against the drill bit.

It is known that, in order to meet rolling and piercing requirements in an optimum manner, the axial thrust on the bar must be considerable, whereas the bar is moved between the cylinders and against the drill bit at a relatively low, constant speed, e.g. on average of the order of 0.4 m/sec.

To this end, use has hitherto been made of a high-power hydraulic or mechanical actuator capable of moving a longitudinally-guided slide at low velocity in a direction parallel to the PPM rolling axis, the slide being fitted with a thrust rod having a longitudinal axis coinciding with the rolling axis and adapted to act on the bar.

A slide of the aforementioned kind can be moved, relative to the PPM, from a remote position in which a space for holding a square bar is left between the free end of the thrust rod and the PPM inlet guide inlet, and a position near the inlet of the double rolling machine but not interferring therewith.

The distance travelled by the square bar between the moment when it is positioned between the thrust rod and the PPM inlet guide and the moment in which it is completely converted into a round axially pierced blank can be divided into the following two sections:

1. Insertion of the bar. This is the travel section between the inlet guide mouth and the position in which the front end of the square bar makes contact with the rolls and 2. The thrust section. This is the remaining distance travelled, during which the bar is thrust between the rolls and against the drill bit and is converted in a desired manner into a corresponding round pierced blank.

Sections 1 and 2 of the aforementioned travel both occur at low velocity, i.e. the fixed low velocity of operation of the actuator. Furthermore, in order to position a new square bar along the rolling axis upstream of the inlet guide, it is necessary to wait until the slide, moved at low velocity by the actuator, has reached the position remote from the PPM so as to leave space for receiving a bar between the thrust rod and the PPM inlet guide.

This results in idle time which considerably affects the productivity of the PPM, due to the low speed hitherto adopted for inserting the bar and for the entire return of the slide to the position remote from the PPM, in addition to the thrust section, during which the low speed is imposed by recognized operational and structural requirements of the PPM. Besides the aforementioned idle time, additional time is required for positioning a new square bar in the space between the thrust rod and the inlet guide mouth. Such positioning has hitherto been brought about by conventional, relatively slow lifting and transfer devices.

This hitherto inevitable idle time has been the main technical disadvantage of conventional positioning, insertion and thrust devices for PPM's. The disadvantage is even more clear when the PPM is used to produce round pierced blanks for a downstream pipe rolling mill which operates at the rate of four or more workpieces per minute.

The invention is based on the problem of providing a device having structural and functional features such that it can position a square bar along a PPM rolling axis in line with a PPM inlet guide, insert the bar through the guide and subsequently thrust the bar between the rolls and against the drill bit in a manner which reduces or completely obviates the aforementioned serious technical disadvantage.

SUMMARY OF THE INVENTION

To this end, according to the invention, the device comprises:

(1) a motor driven shaft rotatably borne by the guide inlet and having its axis of rotation parallel to the rolling axis, (2) a substantially drum-shaped bedplate coaxially keyed to the motor driven shaft, (3) a first thrust means mounted on the drum-shaped bedplate and acting in a line R parallel to the axis of rotation of the motor-driven shaft and separated therefrom by a distance equal to the distance between the axis of rotation and the rolling axis, the first thrust means being adapted to subject a bar to a thrust having a given value in order to roll and simultaneously pierce the bar, (4) a second thrust means mounted on the bedplate and acting in a line $R_1$ parallel to the line of action R of the first thrust means and circumferentially spaced therefrom by a center angle of predetermined value, the line of action R being also at a distance from the axis of rotation of the motor driven shaft equal to the distance between the axis of rotation and the rolling axis, the second thrust means being adapted to subject a bar to a thrust for inserting it into the double rolling machine through the inlet guide, and (5) a motor for angularly moving the motor-driven shaft around its axis of rotation from a position in which the line of action R of the first thrust means coincides with the rolling axis and the line of action $R_1$ of the second thrust means is at an angular distance from the rolling axis to a second position in which the line of action $R_1$ of the second thrust means coincides with the rolling axis and the line of action R of the first thrust means is at an angular distance therefrom.

Advantageously, a device according to the invention is characterised in that the drum-shaped bedplate is formed with a longitudinal seat in axial alignment with the line of action $R_1$ of the second thrust means in order to receive and bear a square bar when the bedplate is in the aforementioned second position.

BRIEF DESCRIPTION OF THE DRAWINGS

Other features and advantages of the invention will be clear from the following detailed description of a preferred but not exclusive embodiment of a device according to the invention with reference to the accompanying drawings, which are given by way of example only and in which.

DESCRIPTION OF A PREFERRED EMBODIMENT

Figure 1:
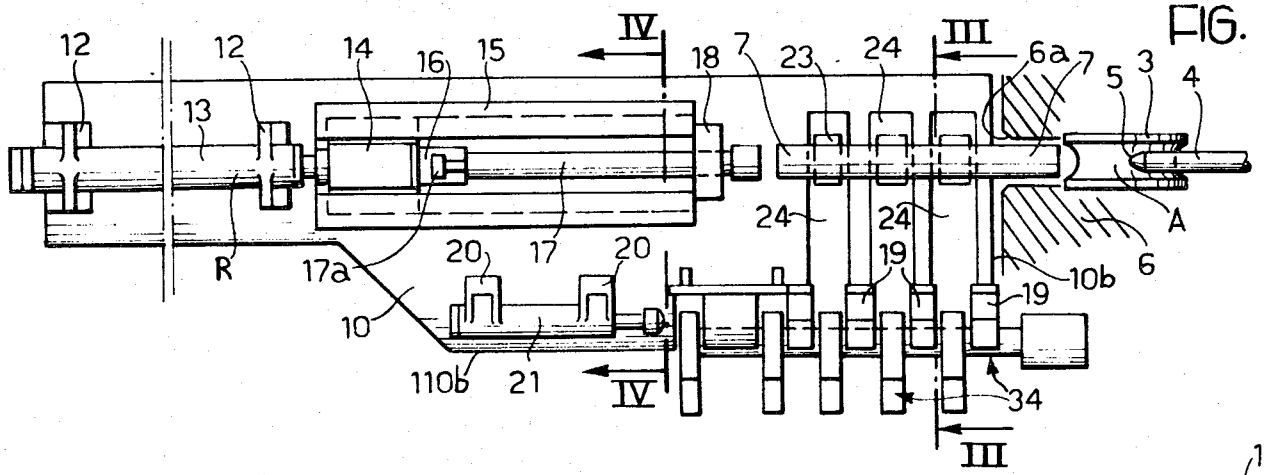
FIG. 1 is a plan view of a device according to the invention.
Figure 2:
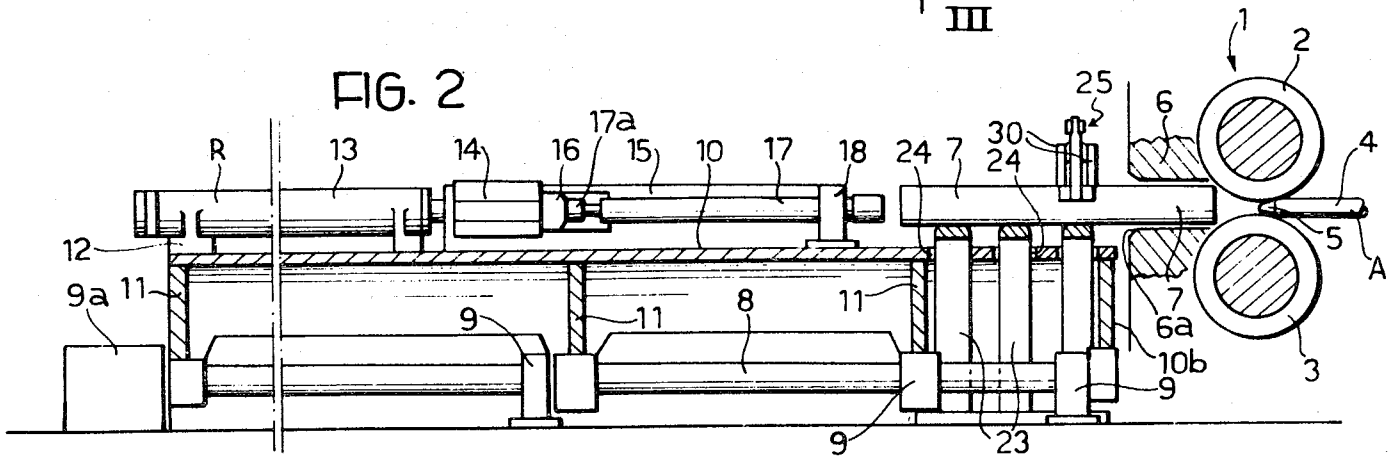
FIG. 2 shows a section along II—II of FIG. 1.

The drawings diagrammatically show a press piercing mill (PPM) 1 which, as is known, mainly comprises a double rolling machine 2, 3 comprising rolls having round grooves, and a bit-bearing mandrel 4 extending along the rolling and piercing axis A on the outlet end of the rolling machine, the mandrel 4 bearing a drill bit 5 at its end facing the rolls 2 and 3. The PPM also comprises a substantially tunnel inlet guide diagrammatically indicated at 6, adapted to guide a square bar 7 to the PPM rolling machine in order to convert it into a round, axially pierced blank.

A conventional motor-driven shaft 8 is parallel to the rolling axis A and disposed upstream of the mouth 6*a* of the inlet guide 6, relative to the direction of advance of the bar 7 through the PPM. Advantageously the longitudinal axis of shaft 8, which is rotatably borne by a number of friction-type bearings 9 and is driven by a conventional motor 9*a*, which lies in the vertical plane containing the rolling axis A.

The general reference 10 denotes a bedplate substantially in the form of a sector of a cylindrical drum and having a cross-section in the form of a circular sector having a fixed outer diameter. Bedplate 10 is coaxially secured, reinforced and spaced from shaft 8 by a number of radial arms 11. At the end 10*a* of bedplate 10 remote from the PPM, conventional means (diagramatically indicated at 12) bear a first thrust means 13, e.g. an hydraulic cylinder, having a line of action R which is horizontal and parallel to the axis of rotation of the motor-driven shaft 8. More particularly, the distance between line R and the axis of rotation is equal to the distance between the axis of rotation and the rolling and piercing axis A of the PPM.

Thrust means 13 acts axially on a slide 14 movably guided in the direction of line R in a conventional guide holder 15 secured by known means to the bedplate 10.

Slide 14 is fitted with a conventional coupling means 16 for bearing and removably holding an end 17*a* of a thrust rod 17 which is held and guided by an appropriate support 18 secured to bedplate 10. Rod 11, which has fixed transverse dimensions adapted for movably engaging the PPM inlet guide 6, is adapted to act axially on a square bar 7 which is to be rolled and simultaneously pierced as described hereinafter.

The thrust means 13 is designed and dimensioned so as to subject slide 14 and consequently rod 17 to a powerful thrust and move the slide at a reduced speed, the thrust and the speed being fixed in accordance with recognized operating requirements for rolling or simultaneously piercing a square bar 7 in a PPM.

A number of saddles 19 are secured by conventional means to the bedplate 10 along its longitudinal side 110*b* and are regularly spaced apart along side 110*b* starting from the end 10*b* of bedplate 10 nearer the PPM. Each saddle 19 comprises an essentially L-shaped holder having one limb 19*a* which extends radially to the exterior of bedplate 10 and another limb 19*b* which is at a tangent to the bedplate. The dimensions and number of saddles 19 are chosen so that they form a seat S for receiving a square bar 7. A second thrust means 21, e.g. hydraulic cylinder, is secured by conventional means diagrammatically indicated at 20 on bedplate 10 and in line with the bar-holding seat. Thrust means 21 has a line of action $R_1$ which is horizontal and parallel to the line of action of thrust means 13 and circumferentially spaced therefrom by a center angle $\alpha$ of predetermined value.

The distance of line $R_1$ from the axis of rotation os shaft 8 is equal to the distance between the last-mentioned axis and the PPM rolling axis A. The thrust means 21, which is adapted to act axially on a bar 7 in the seat made up of a number of saddles 19, which will be described hereinafter, is designed and dimensioned so as to subject bar 7 to a weak thrust but move it faster than the speed of the thrust means 13. Reference 22 denotes a stand, support or the like secured to the ground and extending parallel to the rolling axis A and substantially in line with the PPM inlet guide 6 and below the bedplate 10. Stand 22 mainly comprises a number of uprights 23 which project above the bedplate 10 through a corresponding number of identical slots 24 formed in the circumference of bedplate 10, each slot being open on side 110*b* of the bedplate in position between two adjacent saddles 19.

Uprights 23 are dimensioned and designed to bear a square bar 7 when introduced into the PPM via the inlet guide 6. To this end, uprights 23 are provided which are cooperative with a bar-guiding device 7 (general reference 25) which can be conventional.

Figure 3:
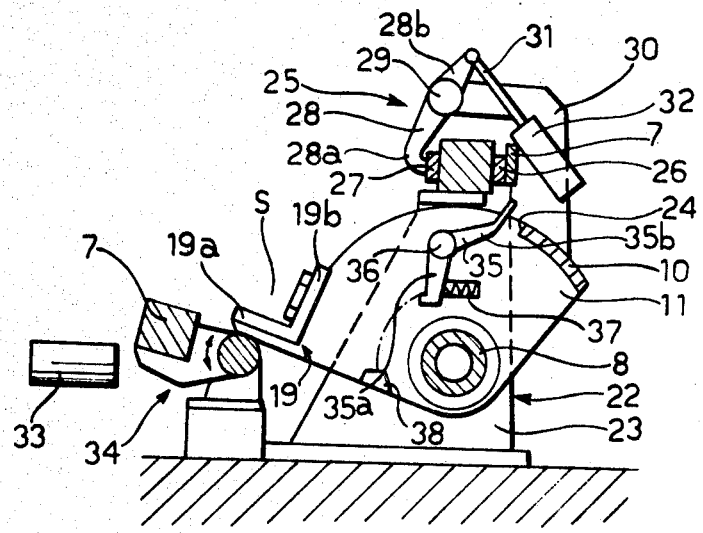
FIGS. 3 and 4 are sections along lines III—III and IV—IV respectively of FIG. 1.
Figure 4:
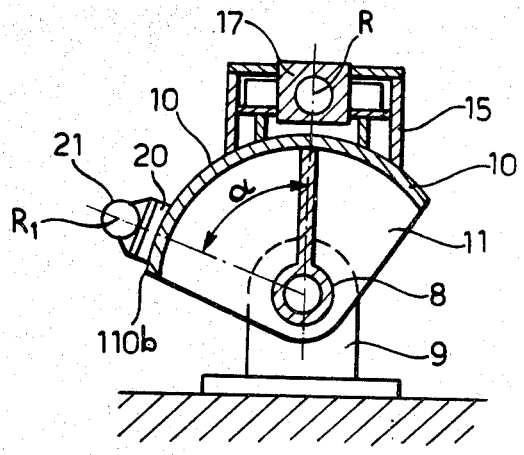

With reference to FIG. 3, a device 25 mainly comprises a pair of linear guide components 26, 27, component 26 being secured at the top to the side of bedplate 10 and extending parallel to the rolling axis A, whereas component 27 is secured to an end 28*a* of a lever 28. Lever 28 rotates around a pivot 29 having a horizontal axis parallel to axis A and borne by the end of a pair of identical arms 30—30 secured to bedplate 10. The other end 28*b* of lever 28 is pivoted to the rod 31 of a hydraulic cylinder 32 which can rotate component 27 from an operative position in which it is parallel to component 26 and co-operates therewith to form a guide for a bar 7, to a tilted position remote from component 26. The entire device 25 for guiding a bar into the PPM is preferably disposed above that upright 23 of the stand 22 which is nearest the inlet guide 6, and its maximum dimension in the direction of the generatrix of bedplate 10 is less than the width of each slot 24. With reference to FIG. 3, the general reference 33 denotes a roller conveyor positioned at the side and at a distance from the bedplate 10. A conventional tilting mechanism (general reference 34) is disposed between the roller conveyor 33 and the bedplate 10 and is designed and dimensioned for transferring a number of square bars 7, one at a time, from conveyor 33 to the bar-receiving seat made up of a number of saddles 19 on bedplate 10.

The device according to the invention operates as follows:

At the beginning of a working cycle, bedplate 10 is positioned at an angle relative to the axis of shaft 8 so that the line of action R of thrust means 13 coincides with the rolling and piercing axis A of the PPM.

When bedplate 10 is in the last-mentioned position the tilting mechanism 34 is disposed so as to receive a square bar 7 from conveyor 33. Linear component 27 of the guide device 25 is in the raised position. Slide 14 and the associated thrust rod 17 are in the retracted position relative to the mouth 6*a* of the PPM inlet guide 6, so that a space for holding a square bar 7 is left between mouth 6*a* and the free end of thrust rod 17. The top flat ends of uprights 23 of stand 22 are also accessible in the last-mentioned space.

A square bar 7 is discharged by conventional means (not shown) from conveyor 33 on to the tilting mechanism 34, which transfers it to the bar-holding seat made up of a number of saddles 19 on bedplate 10. Next, bedplate 10 is moved through an angle and positioned, relative to the axis of rotation of shaft 8, so that the line of action $R_1$ of the thrust means 21 coincides with the rolling and piercing axis A of the PPM. In the last-mentioned position, square bar 7 is positioned along the rolling axis A where it is held by the plurality of uprights 23 and by limbs 19*a* of the plurality of saddles 19 inserted in a coplanar manner between the uprights.

In order to hold bar 7 exactly along the rolling axis A it is advisable to use an appropriate blocking device, which can be conventional. In a preferred embodiment, for example (FIG. 3) the device basically comprises a number of identical levers 35 all keyed to a single pivot 36 which is structurally independent of the bedplate 10 and rotatably supported (in conventional manner not shown) with its axis parallel to the axis of rotation of shaft 8. Each lever 35 has an arm 35*a* extending downwards and acted upon by a respective spring 37 and an arm 35*b* extending upwards through a corresponding slot 24. Bedplate 10 has a number of stops 38 secured in positions so as to cooperate with the bottom ends of arms 35*a* of lever 35.

Towards the end of the angular motion of bedplate 10, abutments 38 make contact with arms 35*a*, of lever 35, against the action of spring 37, and move lever 35 through an angle (counterclockwise in FIG. 3) such that arms 35*b* are vertically positioned and project above bedplate 10 and provide the required stops for bar 7 borne bedplate 10.

When bedplate 10 is held in the desired angular position, cylinder 32 is actuated so as to lower component 27 into the operative position, where it cooperates with component 26 to guide the motion of bar 7.

At the same moment, thrust means 21 is put into operation and rapidly inserts the square bar 7 through the PPM inlet guide 6 until it reaches the mouth and the calibrated passage defined by the rolls 2, 3. Thrust means 21 is returned to the initial position and as soon as the free end of its rod has disengaged from the inlet guide 6, bedplate 10 is rotated to the starting position of the working cycle, in which the line of action R of thrust means 13 coincided with the rolling axis A.

Bedplate 10 is held in the last-mentioned position while a next bar 7 is loaded from the tilting mechanism 34 into the seat formed by the plurality of saddles 19, whereupon thrust means 13, via slide 14 and the associated rod 17, exerts the appropriate powerful thrust on bar 7 after it has been introduced between rolls 2 and 3, and pushes it against drill bit 5.

After bar 7 has been converted into a corresponding axially pierced length, thrust means 13 returns to its initial position and, as soon as the thrust rod 17 has disengaged from the mouth 6*a* of the inlet guide 8, bedplate 10 is rotated to the angular position for inserting a new bar 7 loaded thereon.

The main advantage of the device according to the invention is the considerable reduction in the idle time hitherto required for loading and inserting a bar in a PPM. More specifically:

A square bar for rolling and simultaneous piercing in a PPM can travel through the insertion section, as previously defined, in a very short time, owing to the use of an appropriately dimensioned thrust means 21;

A new square bar can be positioned along the rolling and piercing axis (A) as shown as the thrust rod 17 has disengaged from the PPM inlet guide. The result, compared with the prior art, is the complete elimination of the idle time required in the prior art, since the slide 14 cooperating with the thrust rod 17 returns to its initial position remote from the PPM and thus provides a space for holding the new square bar between the free end of the rod and the mouth of the PPM in the inlet guide;

Additional time is gained when a new square bar is loaded for rolling and piercing during the time when a square bar is being converted into a round axially pierced blank, a new bar is being loaded on the bedplate bearing the thrust means 13 and 21.

Although the aforementioned embodiment of the device is preferred, numerous structural variations can of course be made thereto without departing from the scope of the invention as described in the claims hereinafter.

What is claimed is:

1. A device for inserting and thrusting a bar into a press piercing mill including a rolling machine having a pair of rolls, a piercing bit mounted along the rolling axis (A) of the machine and on the outlet side thereof, an inlet guide for the rolling machine and a bedplate holding the bar and extending along the rolling axis (A) from the inlet side of the guide, such device comprising:

a motor driven shaft rotatably borne by the inlet guide and having its axis of rotation parallel to the rolling axis (A);

a substantially drum-shaped bedplate coaxially keyed to the said motor-driven shaft;

a first thrust means mounted on the said drum-shaped bedplate and acting in a line (R) parallel to the axis of rotation of the said motor-driven shaft and separated therefrom by a distance equal to the distance between the axis of rotation and the rolling axis (A), the first thrust means being adapted to subject a bar to a thrust having a given value in order to roll and simultaneously pierce the bar;

a second thrust means mounted on the said bedplate and acting in a line ($R_1$) parallel to the line of action (R) of the first thrust means and circumferentially spaced therefrom by a center angle ($\alpha$) of predetermined value, the line of action ($R_1$) being also at a distance from the axis of rotation of the said motor-driven shaft equal to the distance between the axis of rotation and the rolling axis (A), the second thrust means being adapted to subject said bar to a thrust for inserting it into the rolling machine through the inlet guide thereof; and a motor for angularly moving the motor-driven shaft around its axis of rotation from a position in which the line of action (R) of the said first thrust means coincides with the rolling axis (A) and the line of action ($R_1$) of the said second thrust means is at an angular distance from the rolling axis (A) to a second position in which the line of action ($R_1$) of the said second thrust means coincides with the rolling axis (A) and the line of action (R) of the first thrust means is at an angular distance therefrom.

2. A device according to claim 1, in which the said drum-shaped bedplate is formed with a longitudinal seat in axial alignment with the line of action ($R_1$) of the said second thrust means in order to receive and bear a square bar when the said bedplate is in the aforementioned second position.

3. A device according to claim 1, said first thrust means being a hydraulic cylinder including a rod adapted to be reciprocated to thrust said bar through said press piercing mill.

4. A device according to claim 1, said second thrust means being a hydraulic cylinder including a rod adapted to be reciprocated to initially insert said bar into the rolling machine through the inlet guide.

5. A device according to claim 2, and further including a fixed linear guide component and a movable linear guide component, said movable linear guide component being actuated by a hydraulic cylinder and being in an operative position when said bar is positioned to be thrusted through said press piercing mill and being in an inoperative position during loading of a said device.

6. A device according to claim 1, and further including a support including a plurality of uprights for operatively positioning said bar relative to said first thrust means along the rolling axis (A).

* * * * *